US008590086B1

(12) United States Patent
Cragg

(10) Patent No.: US 8,590,086 B1
(45) Date of Patent: Nov. 26, 2013

(54) WEAR RESISTING SPAN LOCK SYSTEM

(71) Applicant: Steward Machine Co., Inc., Birmingham, AL (US)

(72) Inventor: Robert L. Cragg, Maple Glen, PA (US)

(73) Assignee: Steward Machine Co., Inc., Birmingham, AL (US)

( * ) Notice: Subject to any disclaimer, the term of this patent is extended or adjusted under 35 U.S.C. 154(b) by 0 days.

(21) Appl. No.: 13/860,636

(22) Filed: Apr. 11, 2013

Related U.S. Application Data

(60) Provisional application No. 61/622,833, filed on Apr. 11, 2012.

(51) Int. Cl.
*E01D 15/06* (2006.01)

(52) U.S. Cl.
USPC ..... 14/41; 14/46

(58) Field of Classification Search
USPC ..... 14/35, 38, 40, 41, 46
See application file for complete search history.

(56) References Cited

U.S. PATENT DOCUMENTS

| | | | | |
|---|---|---|---|---|
| 1,659,250 | A * | 2/1928 | Erdal | 14/41 |
| 2,610,341 | A * | 9/1952 | Gilbert | 14/41 |
| 5,327,605 | A | 7/1994 | Cragg | |
| 6,588,041 | B1 | 7/2003 | Cragg et al. | |
| 6,701,562 | B2 * | 3/2004 | Burke et al. | 14/46 |
| 7,020,924 | B2 * | 4/2006 | Cragg | 14/35 |

* cited by examiner

*Primary Examiner* — Raymond W Addie
(74) *Attorney, Agent, or Firm* — Howson & Howson LLP

(57) ABSTRACT

A wear resisting span lock system for bascule bridges includes a normally-inactive hydraulic lockbar shoe expander operable to minimize sliding engagement of the lockbar with its guiding and receiving shoes only during bridge opening and closing operations.

10 Claims, 3 Drawing Sheets

(Sec. A-A)

(Sec A-A)

WEAR RESISTING SPAN LOCK SYSTEM

CROSS-REFERENCE TO RELATED APPLICATIONS

This application claims the benefit under 35 USC §119(e) of U.S. Provisional Patent Application No. 61/622,833, filed Apr. 11, 2012.

BACKGROUND OF THE INVENTION

This invention relates to improvements in wear compensating energy-absorbing span lock systems, such as disclosed in U.S. Pat. Nos. 5,327,605 and 6,588,041 assigned to Steward Machine Co., Inc.

In the '605 patent, FIG. 1 illustrates in plan view a span lock mechanism connecting aligned ends of a double leaf bascule bridge. FIGS. 7a, 7b and 7c illustrate schematically the motion of a locking bar that connects the ends. Resilient elements are illustrated as Bellville-washer type springs that engage shoes which bear on the end portion of the locking bars to effect the desired resilient connection of the span leafs across their ends.

In the '041 patent, an adjustable pre-load mechanism is provided to maintain a desirable level of continuous contact load pressure between the shoes and locking bar, and to afford manual compensation for wear that may occur over prolonged periods of time in service.

While the mechanisms disclosed in these Patents function satisfactorily for their intended purposes when properly maintained, there is a need to provide an improved mechanism to minimize wear between the shoes and locking bar in an automatic manner when bridges are installed and maintained under less than desirable conditions and environments.

One way to do this contemplates the use of hydraulic cylinders to press the shoes into firm contact with the lockbar with hydraulic pressure while the spans are locked, such as disclosed in FIG. 11 and Col. 5, Lns. 38-43 of the '605 patent. A problem with this concept is that hydraulic pressure would need to be maintained continuously while the bridge is locked for land vehicular traffic. This requires power and costs associated with continuous power, or could require accumulators to maintain contact pressure. The present invention overcomes the disadvantage of the aforedescribed concept by providing a mechanism that eliminates the need for continuous power while the bridge is locked and requiring power only when needed to open and close the bridge. Since bascule bridges are normally locked, and only occasionally opened for passing marine vehicular traffic, substantial savings in overall power consumption can be achieved over the continuous pressure concept referenced.

SUMMARY OF THE INVENTION

In brief, the preferred embodiment of the disclosed invention incorporates with the resilient shoe mounting assembly, a hydraulic actuator, or expander, that functions only to unload the shoes to enable the lockbar to be retracted prior to opening the span, and for unloading the shoes after closing the span and extending the lockbar into position to lock the span for accepting land vehicular traffic. By employing this method of activating hydraulic expanders, the sliding friction that would otherwise occur between the lockbar and the shoes is greatly reduced, thereby minimizing wear on these components while retaining the desirable resilient mounting of the shoes to the span. This minimizes the energy required to perform these functions reliably for many cycles even in hostile salt-rich environments and in bridge installations that may not be maintained properly.

DESCRIPTION OF THE DRAWINGS AND PREFERRED EMBODIMENT

FIG. 1A is an elevational schematic view similar to FIG. 6 of U.S. Pat. No. 5,327,605 illustrating aligned and locked end portions of bascule bridge leafs.

Figure 1A:
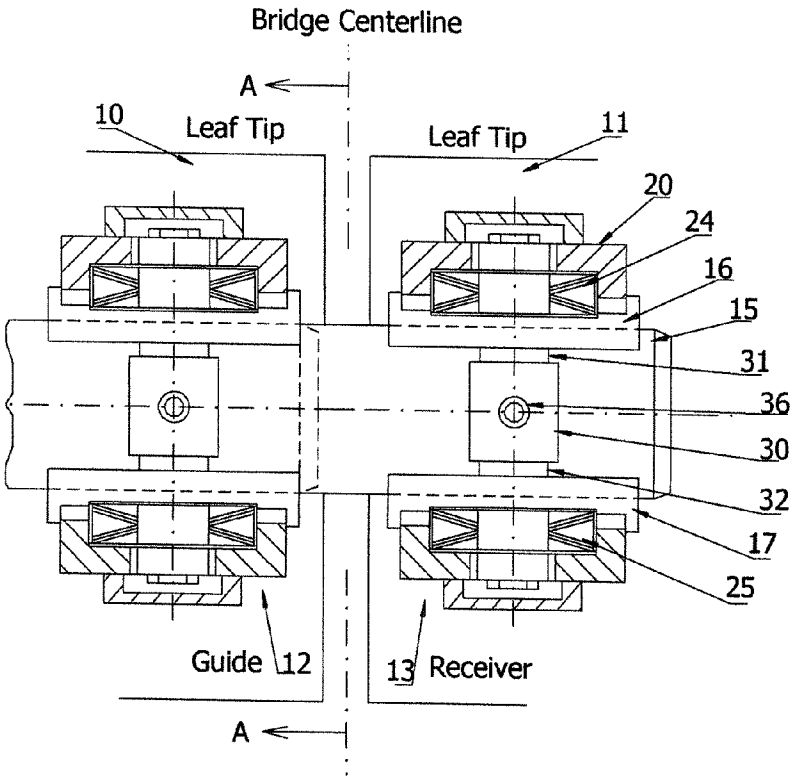
FIG. 1B is an endwise schematic elevational sectional view of the locked bascule bridge leaf portions looking leftward across the bridge centerline in FIG. 1A along line A-A thereof.
Figure 1B:
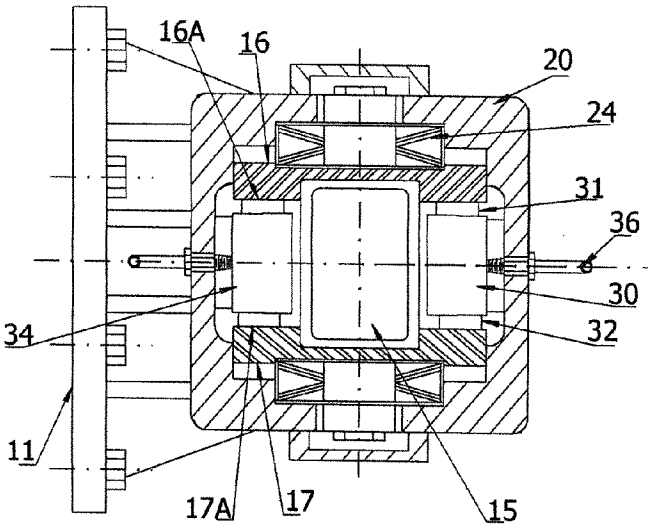

Referring now to the drawings, FIG. 1A illustrates endwise aligned bascule bridge leaf tip webs 10, 11 connected together by a span locking assemblies 12, 13 embodying the present invention. The assemblies include a guide housing 12 and a receiver housing 13 which slidably receive a lockbar 15 shown spanning across the bridge centerline. The guide 12 is of like construction to the receiver 13. Both the guide 12 and the receiver 13 have a pair of lockbar engagable shoes such as the upper shoe 16 and the lower shoe 17 on the receiver 13 as best seen in FIG. 1B. The load shoes 16 and 17 each have a central recess in which the rectangular shaped lockbar is received. The load shoes 16 and 17 are normally biased into engagement with the lockbar 15 by Bellville spring washer assemblies 24, 25, respectively. For more details of the structure and function of the guide and recess components described thus far, reference is made to U.S. Pat. Nos. 5,327,605 and 6,488,041.

As the lockbar 15 moves axially into and out of engagement with its receiver 13, sliding friction can occur on shoe surfaces of the guide 12 and receiver 13, and over time this can cause the shoes to wear and require occasional manual adjustment. To mitigate this problem, the present invention provides each guide and receiver with hydraulic actuators, or jacks, that are operable to separate the shoes from the lockbar only during opening and closing phases of bridge operations. As best seen in FIG. 1B, hydraulic jack actuators 30 and 34 are disposed on horizontally opposite sides of the lockbar 15 and extend vertically between lateral flanges 16*a* and 17*a* on the upper and lower load shoes. Each hydraulic actuator, such as actuator 30, includes a block mounting at least one pair of pistons 31 and 32 capable of moving up and down when hydraulic fluid is admitted into the block under pressure through an inlet 36.

The operation of the system described thus far will now be discussed.

FIG. 1A illustrates the lockbar 15 in the normally closed bridge operating condition with reference to the bridge center line. In this condition, the lockbar is in its extended position spanning across the bridge centerline and engaged in both its guide 12 and its receiver 13. In this position, the hydraulic cylinders 30, 34 are de-pressurized, and the load shoes 16 and 17 are firmly seated against the lockbar 15, being held there by the forces applied by the slightly deflected disk springs 24, 25.

Figure 2A:
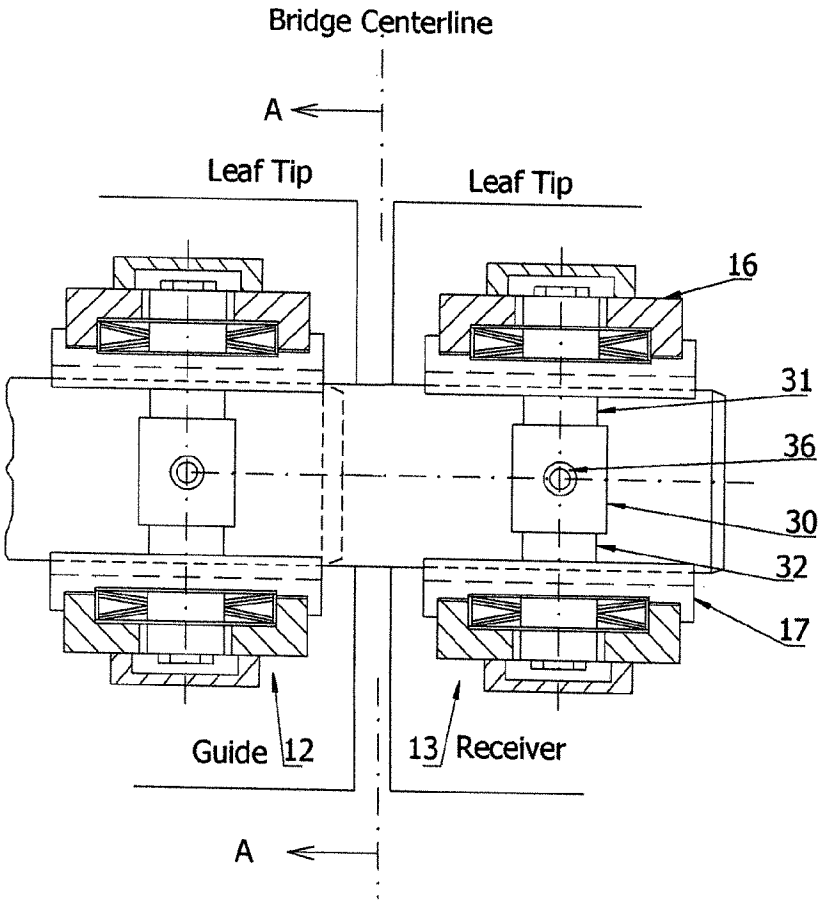
FIG. 2A is a view similar to FIG. 1A, but illustrating schematically the span lock assembly in an unlocking condition.
Figure 2B:
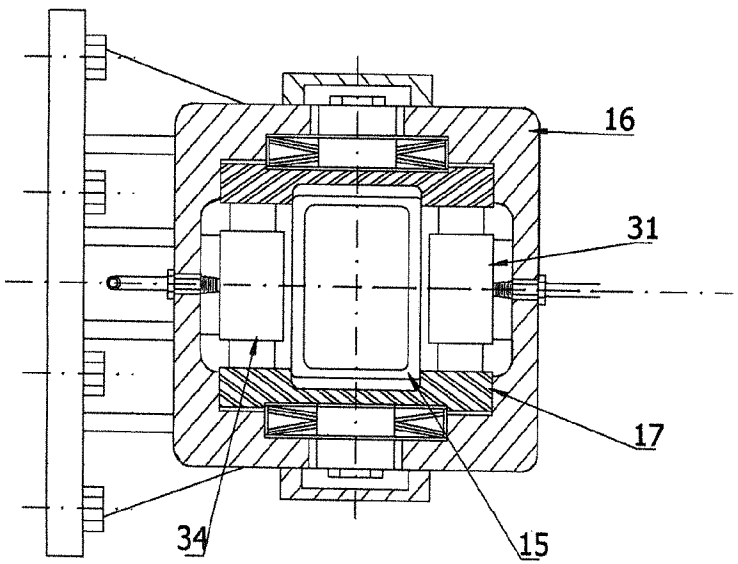
FIG. 2B is a view similar to FIG. 1B, taken along line A-A of FIG. 2A but in the unlocked condition with the lockbar withdrawn from the receiver.

Prior to retracting the lockbar 15 into its guide 12, in response to a bridge opening command, the hydraulic actuators in both the guide 12 and receiver 13 are pressurized to separate the load shoes 16 and 17, so that a small clearance exits above and below the lockbar 15 as shown in FIGS. 2A and 2B. This facilitates retraction of the lockbar 15 into the guide 12 and reduces the possibility of accelerated wear due to interference and friction between the lockbar 15 and load shoe surfaces of the guide and receiver. The load shoes remain separated until the lockbar is fully retracted, such as illustrated in dashed lines in FIG. 1A. After the lockbar is fully retracted, the hydraulic jack actuators are de-pressurized, and the load shoes in the guide 12 are forced into intimate contact with the adjacent lockbar surfaces by means of the springs.

In response to a bridge closing command, to close the bridge for land vehicular traffic after the leaf ends are in substantial alignment, the hydraulic cylinders are again pressurized to separate the guide and receiver load shoes. With the leaf ends properly aligned, and the hydraulic actuators pressurized, the lockbar is extended across the bridge centerline into its receiver, whereupon the hydraulic cylinders are again de-pressurized, and the FIGS. 1A, 1B closed operating position is resumed.

As vehicular traffic passes across the closed leaves, the shear loads are transferred through the spring-loaded energy absorbing load support assemblies. Shock loads are mitigated, and slight wear, which will occur over time, is accommodated by the predetermined spring deflection as well by occasional adjustment of the load support assemblies, which can be accomplished externally, without any disassembly or interruption of bridge service, as described in the above-referenced Patents.

It is important to recognize that the hydraulic system is pressurized only when the lockbar is being inserted or withdrawn. It is not necessary to keep the system pressurized during those long periods of time that the bridge remains closed for the passage of land vehicular traffic. As a result, power consumption is minimized and the risk of hydraulic fluid leakage is minimized.

Figure 3A:
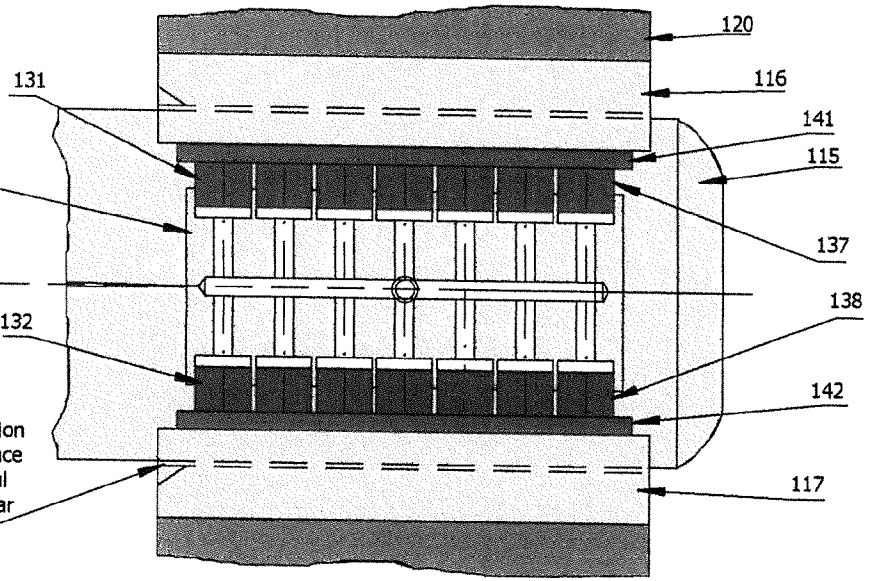
FIG. 3A is a schematic longitudinal sectional view of another preferred embodiment.
Figure 3B:
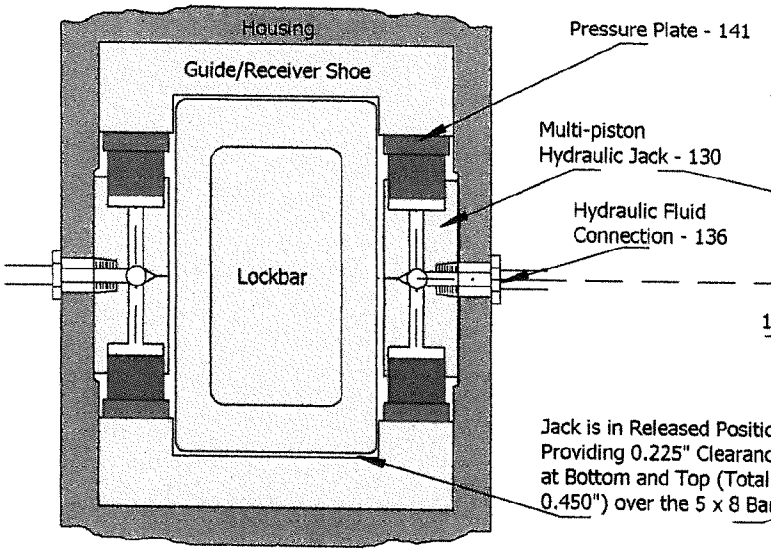
FIG. 3B is a schematic transverse sectional view of the embodiment illustrated in FIG. 3A.

FIGS. 3A and 3B schematically depict a multi-piston version of the embodiment illustrated in FIGS. 1A, 1B and 2A and 2B. In this embodiment, the piston block 130 is provided with a plurality of longitudinally disposed upper cylinders such as 131 and 137, and a like plurality of lower cylinders 132 and 138, aligned diametrically opposite one another below and above the load shoes 116 and 117, respectively. A piston is mounted in each cylinder, such as the pistons 131 and 137 in the upper row, and the pistons 132 and 138 in the lower row. Preferably elongate pressure plates 141 and 142 are disposed between the pistons and the load shoes to distribute forces applied. The piston block 130 is internally bored to provide a gallery of lateral passages for admitting hydraulic fluid from a main inlet passage 136. When hydraulic fluid is supplied under pressure through the inlet 136 (FIG. 3B) the pistons are displaced outwardly of their respective cylinders, and pressure is applied in opposite vertical directions against the pressure plate for separating the load shoes slightly from one another as previously described. De-pressuration, retracts the pistons, as previously described.

The invention claimed is:

1. In a bascule bridge span lock assembly including a lockbar receiver having a pair of opposed lockbar engaging shoes resiliently biased toward one another for normally gripping upper and lower portions of the lockbar when operatively disposed therebetween, the improvement comprising:

a pair of hydraulic expanders disposed laterally of said lockbar portion between said shoes for urging said shoes apart to afford insertion and withdrawal of said lockbar with minimal sliding engagement between said lockbar and said shoes only during opening and closing operations of the bascule bridge.

2. Apparatus according to claim 1 including means for pressurizing and de-pressuring said hydraulic expanders in timed relation with bridge opening and closing commands.

3. Apparatus according to claim 1 wherein each of said shoes has laterally extending flanges and said expanders are disposed between said flanges.

4. Apparatus according to claim 3 wherein each expander includes at least one piston disposed in a cylinder located between said flanges, and said piston is extendable vertically to separate said flanges and their shoes when the cylinder is pressurized and to enable said shoes to engage said lockbar when the cylinder is de-pressured.

5. Apparatus according to claim 4 wherein said cylinder is normally de-pressurized while the bridge is in its normal land vehicular traffic bearing position.

6. Apparatus according to claim 1 including means for adjusting the amount of resilient bias applied to said shoes.

7. A method of automatically compensating for shoe wear in a bascule bridge operating system including a pair of lockbar shoes normally engaged against opposite sides of a span lockbar by compression springs disposed between the shoes and their housing, comprising the steps of:

providing a hydraulic expander between the shoes, and urging the shoes apart from one another by applying hydraulic pressure therebetween only for a portion of the bridge operating cycle.

8. The method according to claim 7 wherein said portion of the bridge operating cycle occurs between a command to open the bridge for marine vehicular traffic and a command to close the bridge for land vehicular traffic.

9. The method according to claim 8 wherein said hydraulic pressure is relieved for at least as long as the bridge is normally closed for land vehicular traffic.

10. The method according to claim 9 wherein said hydraulic pressure is also relieved for as long as the bridge is open to permit passage of marine vehicular traffic.

* * * * *